United States Patent [19]

Shih

[11] Patent Number: 4,549,955

[45] Date of Patent: Oct. 29, 1985

[54] PROCESS FOR STABILIZING HYDROPROCESSED LUBRICATING OIL STOCKS BY THE ADDITION OF HYDROGEN SULFIDE

[75] Inventor: Stuart S. Shih, Cherry Hill, N.J.

[73] Assignee: Mobil Oil Corporation, New York, N.Y.

[21] Appl. No.: 676,965

[22] Filed: Nov. 30, 1984

Related U.S. Application Data

[63] Continuation-in-part of Ser. No. 558,075, Dec. 5, 1983, abandoned, which is a continuation-in-part of Ser. No. 386,486, Jun. 9, 1982, abandoned.

[51] Int. Cl.[4] ..... C10G 49/08; C10G 47/16

[52] U.S. Cl. ..... 208/59; 208/89; 208/97; 208/111; 208/143

[58] Field of Search ..... 208/59, 89, 97, 111, 208/143

[56] References Cited

U.S. PATENT DOCUMENTS

| | | | |
|---|---|---|---|
| 2,914,470 | 11/1959 | Johnson et al. | 208/27 |
| 3,668,113 | 6/1972 | Burbidge et al. | 208/97 |
| 3,804,742 | 4/1974 | Bennett et al. | 208/111 |
| 3,870,624 | 3/1975 | Tice et al. | 208/143 |
| 3,894,938 | 7/1975 | Gorring et al. | 208/97 |
| 3,904,511 | 9/1975 | Heiba et al. | 208/288 |
| 3,904,513 | 9/1975 | Fischer et al. | 208/264 |
| 4,090,953 | 5/1978 | Bridger et al. | 208/288 |
| 4,181,598 | 1/1980 | Gillespie et al. | 208/18 |
| 4,210,521 | 7/1980 | Gorring et al. | 208/89 |
| 4,283,271 | 8/1981 | Garwood et al. | 208/59 |
| 4,283,272 | 8/1981 | Garwood et al. | 208/59 |
| 4,292,166 | 9/1981 | Gorring et al. | 208/97 |
| 4,294,687 | 10/1981 | Pinaire et al. | 208/89 |
| 4,400,265 | 8/1983 | Shen | 208/97 |
| 4,437,936 | 3/1984 | Oleck et al. | 208/97 |
| 4,437,975 | 3/1984 | Gillespie et al. | 208/58 |
| 4,490,242 | 12/1984 | Oleck et al. | 208/97 |

*Primary Examiner*—D. E. Gantz
*Assistant Examiner*—Lance Johnson
*Attorney, Agent, or Firm*—A. J. McKillop; M. G. Gilman; L. P. Hobbes

[57] ABSTRACT

Lubricating oil stocks produced by methods such as catalytic dewaxing or hydrocracking, comprising hydroprocesses, are stabilized against oxidation by the addition of hydrogen sulfide to the hydroprocessing hydrogen-containing feed using hydroprocess effluent as a source of said hydrogen-containing feed. The $H_2S$ present in the hydrogen-containing feed saturates olefins that contribute to oxidation instability and restores antioxidant sulfur compounds such as thiols to the lube stock.

13 Claims, 1 Drawing Figure

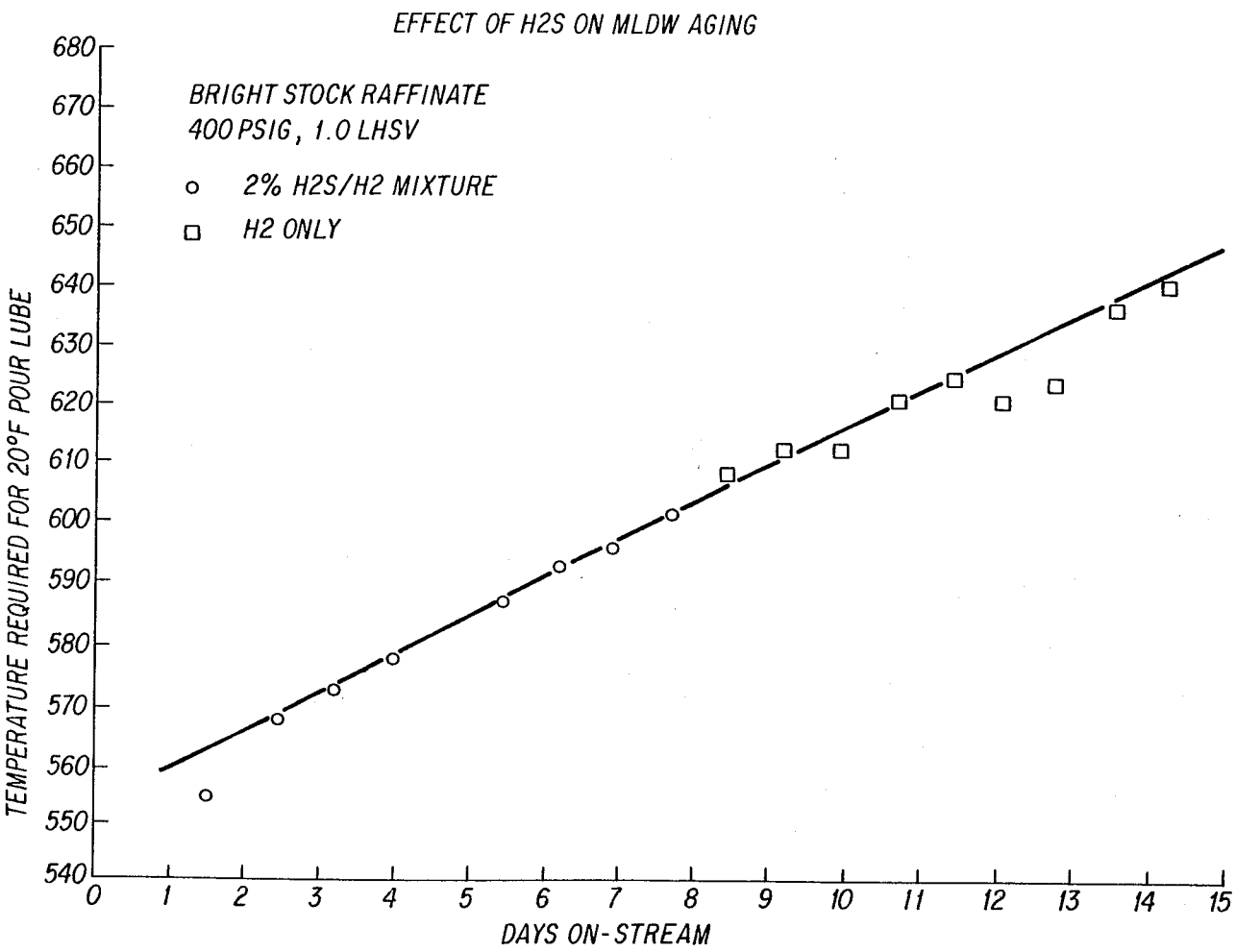
EFFECT OF H2S ON MLDW AGING
BRIGHT STOCK RAFFINATE
400 PSIG, 1.0 LHSV
2% H2S/H2 MIXTURE
H2 ONLY
TEMPERATURE REQUIRED FOR 20°F POUR LUBE
680
670
660
650
640
630
620
610
600
590
580
570
560
550
540
0
1
2
3
4
5
6
7
8
9
10
11
12
13
14
15
DAYS ON-STREAM

PROCESS FOR STABILIZING HYDROPROCESSED LUBRICATING OIL STOCKS BY THE ADDITION OF HYDROGEN SULFIDE

CROSS REFERENCE TO RELATED APPLICATIONS

This application is a continuation in part of patent application Ser. No. 558,075, filed Dec. 5, 1983 which is a continuation in part of patent application Ser. No. 386,486, filed June 9, 1982 both of which are now abandoned.

BACKGROUND OF THE INVENTION

1. Field of the Invention

This invention relates to the production of improved lubricating oils. In particular, it relates to a method of preparing stable lubricating oils which are highly resistant to oxidation and sludge formation when exposed to a highly oxidative environment. More particularly, it relates to a method of stabilizing hydroprocessed lube stocks by the addition of hydrogen sulfide to the hydrogen feed, without significantly increasing catalyst aging rate.

2. Description of Related Art

It is well known that certain types of organic compounds are normally susceptible to deterioration by oxidation or by corrosion through coming into contact with various metal surfaces. For example, it is known that liquid hydrocarbons in the form of fuels or lubricating oils tend to accumulate considerable quantities of water when maintained for long periods of time in storage vessels; and when subsequently brought into contact with metal surfaces in their functional environments, deterioration as a result of corrosion occurs. As a further example, in modern internal combustion engines and in turbojet engines, lubricants can be attacked by oxygen or air at high temperatures to form heavy viscous sludges, varnish and resins which become deposited on the engine surfaces. As a result, the lubricant cannot perform its required task effectively, and the engine does not operate efficiently. Furthermore, the sludges produced by lubricant deterioration generated by insufficient oxidative stability tend to foul and plug low tolerance hydraulic system components and interconnecting piping and valves. In addition, where such lubricating oils or other corrosion-inducing materials are incorporated into solid lubricants as in the form of greases, similar results are encountered, thus clearly indicating the necessity for improved methods of treatment which increase the oxidative stability of lubricating oils.

Accompanying the deterioration of lubricants by oxidation is the resultant corrosion of the metal surfaces for which such lubricants are designed and supplied. Once a lubricant has been oxidized to produce viscous sludges and resins, acids develop which are corrosive enough to destroy most metals. Moreover, the friction between metal parts increases following lubricant breakdown due to oxidation and leads to excessive metal wear. Increasing demands on lubricants, brought about by the widespread introduction of engines operating at steadily increasing temperatures, pressures, and speeds, necessitate a constant search for new methods of hydrocarbon treatment which can provide lubricants with increased oxidation resistance.

Due to the lubricant oxidative stability requirements for newer engines and other rotating or moving equipment lubrication, feedstocks which were previously suitable for lubricant production are presently unsuitable or at best marginal for such uses. Thus at a time when overall lubricant demands are increasing, the amount of suitable lubricant feedstock material is being diminished due to the oxidative stability requirements of newer machinery.

In order to produce lube stocks of suitable pour point from paraffin-containing feedstocks, it is generally necessary to remove significant amounts of hydrocarbon waxes from such feedstocks. Distillate fractions of suitable boiling ranges for lube base stock can be dewaxed by extraction with solvent mixtures such as methyl ethyl ketone and toluene, or methyl ethyl ketone and methyl isobutyl ketone. Because solvent extraction processes generally require large amounts of expensive solvents, alternative or supplemental methods of dewaxing have been devised.

In recent years techniques have become available for catalytic dewaxing of petroleum stocks. A process of that nature developed by British Petroleum is described in The Oil and Gas Journal dated Jan. 6, 1975, at pages 69–73. See also U.S. Pat. No. 3,668,113, incorporated herein by reference.

In U.S. Pat. No. Re. 28,398, incorporated herein by reference, is described a process for catalytic dewaxing with a catalyst comprising zeolite ZSM-5. Such process combined with catalytic hydrofinishing is described in U.S. Pat. No. 3,894,938, also incorporated herein by reference.

In U.S. Pat. No. 4,137,148 is described a process for preparing specialty oils of very low pour point and excellent stability from a waxy crude oil distillate fraction by solvent refining, catalytic dewaxing over a zeolite catalyst such as ZSM-5, and hydrotreating, under specific conditions. The entire contents of that patent are incorporated herein by reference.

Hydrocarbon lubricating oils have been obtained by a variety of processes in which high boiling fractions are contacted with hydrogen in the presence of hydrogenation-dehydrogenation catalysts at elevated temperatures and pressures. One such process is disclosed in U.S. Pat. No. 3,755,145, incorporated herein by reference, relating to catalytic lube dewaxing using a shape-selective zeolite catalyst, a large pore cracking catalyst such as clay or silica, and a hydrogenation/dehydrogenation catalyst. In U.S. Pat. No. 4,181,598, incorporated herein by reference, a lube base stock oil of high stability is produced from a wax crude oil fraction by solvent refining, catalytic dewaxing over a shape-selective zeolite and hydrotreating under specified conditions. In both processes, there is a consumption of hydrogen and lubricating oil fractions are separated from the resulting products. The separated lubricating oil fractions differ from those obtained by fractional distillation of crude oils and the like, in that they have relatively higher viscosity index values. These lubricating oil fractions suffer from the shortcoming that they are unstable when exposed to highly oxidative environments. When so exposed, sediment and lacquer formation occurs, thus lessening the commercial value of such lubricants. The instability of catalytically dewaxed lube base stocks arises from the presence of easily oxidizable olefins in the catalytically dewaxed product. Efforts to saturate these olefins by reacting them with hydrogen, i.e., hydroprocessing, have been successful in significantly reducing the olefin content. However, prior art methods of hydroprocessing result in the removal of antioxicant sulfur compounds such as thiols or sulfides from the hydroprocessed product, thus lowering its oxidation stability.

The anti-oxidation capability of sulfur compounds is known. See G. H. Denison, Jr. and P. C. Condit "Oxidation of Lubricating Oils," Industrial and Engineering Chemistry, Vol. 37, No. 11, pp 1102–1108, 1945; D. Barnard et al, "The Oxidation of Organic Sulphides, Part X: The Co-Oxidation of Sulfides and Olefins", J. Chem. Soc., pp. 5339 to 5344, 1961. Several methods have been discovered whereby sulfur in various forms is added to improve petroleum products.

U.S. Pat. No. 2,914,470 is directed to hydrorefining a petroleum oil fraction by contacting it with a catalyst in the presence of hydrogen sulfide for the purpose of increasing the life of the catalyst. Increases of hydrogen sulfide concentration employed result in decreases in the sulfur content of the product.

U.S. Pat. No. 3,972,853 relates to a process for preparing a stabilized lubricating oil resistant to oxidation which includes contacting the lubricating oil stock with a small amount of elemental sulfur (0.1 to 0.5 percent by weight) at a mild contact temperature of about 25° C. to about 130° C. The elemental sulfur may be added as such or else generated in situ from sulfur precursors such as $H_2S$ or an added organosulfur compound.

U.S. Pat. No. 3,904,513 is directed to a method of improving the oxidative stability of solvent refined lube stocks. These lubricating base charge stocks are contacted with a catalyst containing nickel-molybdenum on a large pore alumina catalyst in the presence of a gas mixture of about 90% $H_2$ and 10% $H_2S$ under hydrofinishing conditions. Hydrofinishing under these conditions results in a product which contains significant amounts of sulfur materials which contribute to the oxidative stability of the lube stock. However, it is also known that the presence of $H_2S$ in the hydrogen feed deleteriously affects the catalyst used in the hydrodewaxing of hydrocarbons. Excessive $H_2S$ in the hydrogen feed results in the undersirable acceleration of of catalyst aging rate on significant increases in product pour point, see, e.g., U.S. Pat. No. 4,283,272, incorporated herein by reference.

SUMMARY OF THE INVENTION

It has now been found that improved results can be obtained in the catalytic hydrodewaxing of lube stocks to produce stabilized lube oils having high viscosity indexes, low pour points, and increased resistance to oxidation, without deleteriously affecting the aging rate of the catalyst. The process of the present invention presents an improved alternative to prior art hydroprocessing treatments. In lieu of hydroprocessing employing a straight conventional hydrogen feed, the catalytically dewaxed lube stocks are treated with a hydrogen/hydrogen sulfide mixture wherein the hydrogen sulfide content ranges from about 0.5 to 5 percent by volume, preferably about 1 to 3 percent by volume, say about 2 percent by volume. In other words, the present invention relates to a method for processing the lube stock which comprises first, catalytic dewaxing of the lube stock in a catalytic dewaxing zone with a hydrogen-containing feed in the presence of a dewaxing catalyst comprising a shape-selective zeolite having a silica to alumina ratio of at least about 12, and a constraint index of about 1 to 12. The catalytic dewaxing is followed by cascading the dewaxer effluent, including the hydrogen-containing feed, to a hydrotreating or hydrofinishing zone where the effluent is contacted with a conventional hydrofinishing catalyst. The hydrogen-containing gaseous effluent from the hydrotreating zone may be recycled to the catalytic dewaxing zone in order to provide at least some or all of the hydrogen and hydrogen sulfide required. In addition, the hydrotreating zone effluent may be monitored to determine its content of hydrogen and hydrogen sulfide. Make-up increments of hydrogen and/or hydrogen sulfide may be added as needed to maintain the desired proportion of hydrogen and hydrogen-sulfide in the effluent prior to passing it to the catalytic dewaxing zone. An improvement of the present invention resides in using the hydrogen-containing feed which contains about 0.5 to 5% hydrogen sulfide by volume, preferably about 1 to 3 percent by volume, say about 2 percent by volume. Hydrogen-containing feeds containing such levels of hydrogen sulfide are useful in that they contribute to the oxidation stability of the product without significantly reducing the catalyst aging rate of the dewaxing catalyst. The present invention also related to a process for stabilizing catalytically hydrodewaxed lube stocks which comprises a hydroprocessing step whereby hydrogen sulfide is added to the hydroprocessing hydrogen-containing feed to the extent that the resulting feed mixture contains about 0.5–5 percent hydrogen sulfide by volume, preferably about 1 to 3 percent, say about 2 percent by volume. The hydrogen sulfide can be obtained from various sources including the waste gases generated in the hydroprocessing of the lube stocks, for example, in the hydrotreating zone. The present invention is particularly advantageous in that it generally requires no removal of hydrogen sulfide from the reactor effluents. This results in a simplified, more economical catalytic dewaxing process which produces a product of low olefin content having significant amounts of antioxidant sulfur-containing compounds.

The addition of hydrogen sulfide to olefin materials can be represented by the following equation:

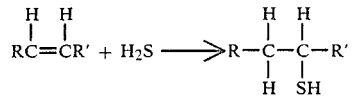

This reaction serves not only to saturate the olefins present in the feed but increases mercaptan or thiol content in the feed as well. The instant process enhances the oxidation resistance of catalytically hydrodewaxed lube stocks because it saturates olefins thus reducing the concentration of these easily oxidizable compounds. Furthermore, anti-oxidant sulfur compounds lost in previous catalytic dewaxing or hydrocracking processes are replaced by the mercaptan reaction products. Consequently, the olefin content of the lube stocks is reduced, without significantly diminishing the anti-oxidant sulfur compound content of the resulting product. In addition to reducing olefins and increasing anti-oxidant sulfur content, the process of the present invention advantageously permits to some extent, substitution of inexpensive sour gas ($H_2S$) for hydrogen.

The process of the present invention is suited for lube base stock refining methods comprising hydroprocessing, that is, processes which consume hydrogen. These include the lube dewaxing processes disclosed in U.S. Pat. Nos. Re. 28,398, 3,894,938 and 4,181,598, incorporated herein by reference. Also included among the processes of the present invention are those wherein a lube stock is catalytically dewaxed with a shape-selective zeolite catalyst, such as Ni/ZSM-5 and hydrofinished with a conventional hydrofinishing catalyst such as cobalt-molybdenum. Hydrogen sulfide may be advantageously present in the hydrogen-containing feed of only the hydrofinishing step or it may be present in the hydrogen-containing feed of either or both the catalytic dewaxing and hydrofinishing steps.

DESCRIPTION OF SPECIFIC EMBODIMENTS

The lubricating oil stock which may be treated in accordance with the present invention may generally be any high boiling range materials boiling above about 316° C. (600° F.). Such lubricating oil stock materials include those obtained by fractionation, as by, for example, vacuum distillation, of crude oils identified by their source, i.e., Pennsylvania, Midcontinent, Gulf Coast, West Texas, Amal, Kuwait, Barco, Aramco and Arabian. The oil stock material may have a substantial part of the fractionation product of the above crude oils mixed with other oil stocks.

Both high sulfur oil stock, i.e. stock having a sulfur content above about 0.4 weight percent, and low sulfur oil stock may be treated in accordance herewith to achieve a stabilized lubricating oil stock.

In catalytic dewaxing, the lubricating oil stock, which may be subjected to a conventional solvent dewaxing step to produce a lube stock of intermediate pour point, is contacted with a catalyst in the presence of a hydrogen-containing feed containing anywhere from about 0.5 to 5 percent, preferably about 1 to 3 percent, say about 2 percent hydrogen sulfide by volume, at elevated temperatures and pressures for a period ranging from about 10 to 60 days. The temperature can range from about 204° to 427° C. (400° to 800° F.), preferably 260° to 371° C. (500° to 700° F.). Pressures from atmospheric to about 100 p.s.i.g. and higher may be used although a preferred range is from about 400 to 2000 p.s.i.g. A suitable liquid hourly space velocity (LHSV) ranges from about 0.2 to 2 volumes of oil per hour per volume of catalyst, although space velocities of from about 0.1 to 10 may be used. Advantageously, hydrogen/hydrogen sulfide feed rates ranging from about 500 to 5000 s.c.f.b. (standard cubic feet per barrel) of charge may be present, preferred rates being about 1000 to 3000 s.c.f.b. The hydrogen-containing feed may be obtained from any suitable source, preferably from the gaseous effluent of the hydrotreating zone.

The dewaxing catalyst can be a composite of hydrogenation metal, preferably a metal of Group VIII of the Periodic Table, associated with a highly siliceous zeolite having a silica/alumina ratio of at least about 12 and a constrained access to the intracrystalline free space, such that the zeolite has a constraint index of about 1 to 12. Dewaxing catalysts suitable for the present invention such as Ni/ZSM-5 are described in U.S. Pat. No. 4,181,598.

Upon completion of the dewaxing step, the resulting lube stock can be passed to a separator where lighter components such as ammonia, hydrogen sulfide and light gas, e.g. methane, ethane and ethylene, are removed. However, a separator is not generally necessary for the removal of $H_2S$ from the dewaxed lube stock because the process of the present invention can preferably utilize such $H_2S$ impurities as a component of the hydrogen-containing feed. This obviates any need for a separator. The resulting lube stock which contains easily oxidizable olefins can be hydrofinished in a hydrotreating step employing a conventional hydrotreating catalyst.

Any of the known hydrotreating catalysts consisting of a hydrogenation component of a non-acidic support may be employed in the hydrotreating or hydrofinishing step. Such catalysts include, for example, a cobalt-molybdate hydrogenation component or nickel-molybdate hydrogenation component, on an alumina support. Suitable temperatures for this step can range from about 204° to 427° C. (400°–800° F.), preferably about 260° to 371° C. (500° to 700° F.). In the process of the present invention the hydrogen-containing feed to the hydrotreating reactor may be mixed with hydrogen sulfide to the extent that the resulting mixture contains anywhere from about 0.5 to 5 percent by volume hydrogen sulfide, preferably about 1 to 3 percent by volume, say about 2 percent by volume hydrogen sulfide. The hydrogen sulfide can be obtained from various sources, e.g. as effluent from the dewaxing zone, the aforementioned separation step which follows dewaxing or even from the hydrogen-containing effluent of the hydrotreater. The hydrotreating step can be run at pressures ranging from about 100 to 3000 p.s.i.g., preferably about 400 to 2000 p.s.i.g., liquid hourly space velocities ranging from about 0.1 to 10 $hr^{-1}$, preferably about 0.2 to 2.0 $hr^{-1}$, and hydrogen/hydrogen sulfide feed rates ranging from about 500 to 5000 s.c.f.b., preferably about 1000 to 3000 s.c.f.b. The duration of the hydrotreating step can vary depending on the olefin content of the hydrocarbon feed, extent of saturation required, temperature pressure, space velocity and feed rate. The effluent of the hydrotreater can be stripped or topped by distillation, removing the most volatile components to meet flash and fire point specifications.

Whereas the present invention has been described in terms of current technology, it is to be understood of course that as lube oil refining technology continues to evolve, new solvents for solvent-refining, modifications of dewaxing and fractionation procedures and other innovations will continue to be proposed. Therefore, it is to be understood, that this invention is not limited to the specific description contained herein, but is adaptable to innovations in the unit processes themselves. In this spirit, then, the following examples are given as illustrative of this invention and are not to be construed as limiting thereon except as defined by the claims. In the examples, all parts are given by weight unless specified otherwise.

EXAMPLES 1-11

An Arabian light bright stock having the properties shown in Table I was catalytically dewaxed and subsequently hydrofinished in 11 consecutive runs employing the same catalysts. The catalytic dewaxing zone employed a ZSM-5 catalyst while the hydrofinishing zone employed a cobalt-molybdenum catalyst. The first five runs used a $H_2S/H_2$ feed to both the catalytic dewaxing reactor and the hydrofinishing reactor which feed contained 2% by volume hydrogen sulfide. The following 6 runs employed a pure hydrogen feed to both reactors. Operating conditions for the runs included a pressure of 400 p.s.i.g., hydrogen or hydrogen-hydrogen sulfide circulation rates ranging from 1970 to 2670 s.c.f.b. and LHSVs ranging from 0.8 to 1.1. The temperature in the catalytic dewaxing reactor increased from an initial 295° C. (563° F.) for the first run to 335° C. (635° F.) for the 11th run. The second reactor was maintained at temperatures ranging from about 288° to 294° C. (550° to 562° F.). Each run lasted about 18 hours. A noticeable overall increase in sulfur content was observed in the products of the runs wherein hydrogen sulfide was combined with the hydrogen feed gas. Table II shows the operating conditions and properties of the lube fractions resulting from the above-described runs.

BRIEF DESCRIPTION OF THE DRAWING

FIG. 1 shows the effects of $H_2S$ addition on catalyst aging. The reactor temperatures on FIG. 1 have been corrected to the temperatures required to achieve a −6.7° C. (20° F.) pour point in the 343° C.+ (650° F.+) lube products (1° reactor temperature rise per 1° pour point). The fresh catalyst of the first cycle had an aging rate of about 3.3° C./day (6° F./day). Initially, the hydrogen feed of the first cycle contained 2% hydrogen sulfide. Upon changing to 100% hydrogen in the last half of the cycle, the aging rate was slightly lowered to about 2.8° C./day (5° F./day). Such a difference is not considered a significant adverse effect, particularly when the enhanced resistance to oxidation of the $H_2S$ treated product is considered.

TABLE I

| Arabian Light Bright Stock Properties - 343° C.+ (650° F.+) | |
|---|---|
| Gravity, API | 24.8 |
| Hydrogen, (wt. %) | 13.3 |
| Sulfur, (wt %) | 1.15 |
| Nitrogen (ppm) | 170 |
| Bromine No. | 2.7 |
| Pour Point | 43° C. (110° F.) |

TABLE II

Effect of Hydrogen Sulfide Addition to Hydrogen Feed in Catalytic Dewaxing and Hydrofinishing

| | EXAMPLE | | | | | | | | | | |
|---|---|---|---|---|---|---|---|---|---|---|---|
| | 1 | 2 | 3 | 4 | 5 | 6 | 7 | 8 | 9 | 10 | 11 |
| Operating Conditions: | 2% $H_2S$ /98% $H_2$ | | | | | | | 100% $H_2$ | | | |
| Pressure, p.s.i.g. | 400 | 400 | 400 | 400 | 400 | 400 | 400 | 400 | 400 | 400 | 400 |
| Dewaxing Reactor Temp. °F. | 563 | 580 | 587 | 595 | 600 | 604 | 614 | 619 | 627 | 631 | 635 |
| Hydrofinishing Reactor Temp. °F. | 550 | 553 | 554 | 551 | 551 | 551 | 551 | 550 | 550 | 559 | 562 |
| LHSV (Based on Dewaxing Reactor) | 0.8 | 0.9 | 0.9 | 0.9 | 1.1 | 1.0 | 1.0 | 1.0 | 1.0 | 0.9 | 0.9 |
| Lube Fraction Properties (650 ° F.+): | | | | | | | | | | | |
| Gravity, °API | 25.0 | 24.2 | 24.6 | 24.5 | 24.7 | 24.8 | 25.1 | 24.4 | 24.9 | 24.6 | 24.6 |
| Hydrogen, wt % | 13.29 | 13.51 | 13.43 | 13.47 | 13.42 | 13.41 | 13.39 | 13.44 | 13.40 | 13.44 | 13.42 |
| Sulfur, wt % | 1.02 | 1.13 | 1.13 | 1.12 | 1.17 | 1.16 | 1.12 | 1.12 | 1.05 | 0.99 | 0.99 |
| Nitrogen, PPM | 200 | 198 | 179 | 191 | 187 | 185 | 192 | 193 | 190 | 160 | 130 |
| Bromine No. | 0.1 | 0.7 | 0.5 | 0.3 | 0.4 | 0.5 | 0.7 | 0.3 | 0.4 | 0.2 | 0.2 |
| Pour Point, °F. | 20 | 5 | 5 | 5 | 10 | 5 | 5 | 5 | 5 | 10 | 10 |

EXAMPLE 12

To compare oxidation stability of the lube fractions, four samples of the 343° C.+ (650° F.+) bottoms obtained from Examples 4, 5, 9, and 10 were submitted for the B-10 fraction test. For the B-10 test, 50 c.c. of oil is placed in a glass all together with iron, copper, and aluminum catalysts and a weight lead corrosion specimen. The cell and its contents are placed in a bath maintained at 163° C. and 10 liters/hr of dried air is bubbled through the sample for 40 hours. The cell is removed from the bath and the catalyst assembly is removed from the cell. The oil is examined for the presence of sludge and the Neutralization Number (ASTM D644) and Kinematic Viscosity at 100° C. (ASTM D445) are determined. The lead specimen is cleaned and weighed to determine the loss in weight.

The results show that the oxidation stability of the lubes produced with 2 percent $H_2S$/98 percent $H_2$ mixture is significantly improved. The B-10 Oxidation Tests are summarized in Table III. As shown in Table II, the experiments of Examples 4 and 5 were conducted with a 2 percent $H_2S$/98 percent $H_2$ gas mixture; and the experiments of Examples 9 and 10 were conducted with 100% $H_2$. The lubes obtained from Examples 4 and 5 result in lower lead loss, lower neutralization number, and less viscosity changed as compared to the lubes obtained from Examples 9 and 10. These results all indicate that the presence of $H_2S$ in the gas phase improves the oxidation stability of the lube products.

TABLE III

| Oil source, Example No. | 4 | 5 | 9 | 10 |
|---|---|---|---|---|
| Gas used in experiments. | 2% $H_2S$/98% $H_2$ | | 100% $H_2$ | |
| B-10 Oxidation Test of the Lube Fractions | | | | |
| Sludge | Nil | Nil | Nil | Nil |
| Lead Loss, grams | 0.1 | 0.0 | 0.5 | 0.2 |
| Neutralization No. (ASTM D644) | 4.97 | 3.16 | 6.13 | 6.09 |
| K.V. @ 100° C., C.S. before B-10 test | 31.97 | 30.61 | 29.69 | 29.63 |
| K.V. @ 100° C., C.S. after B-10 test | 39.95 | 35.13 | 40.67 | 40.37 |
| Viscosity change, @ 100° C., % | 25.0 | 14.8 | 37.0 | 36.2 |

What is claimed is:

1. In a method of processing a lube stock comprising (a) catalytic dewaxing of said lube stock in a catalytic dewaxing zone at temperatures ranging from about 204° to 427° C. (400° to 800° F.) and pressures ranging from at least about atmospheric, with a hydrogen-containing feed in the presence of a dewaxing catalyst comprising a shape-selective zeolite having a silica to alumina ratio of at least about 12, and a constraint index of about 1 to 12 and, (b) cascading the dewaxer effluent of the dewaxing step, including hydrogen-containing gaseous effluent, to a hydrotreating zone wherein said effluent is contacted with a conventional hydrotreating catalyst at temperatures ranging from about 204° to 427° C. (400° to 800° F.) and pressures ranging from about 100 to 3000 psig, the improvement which comprises enhancing oxidation stability of said lube stock by utilizing a hydrogen-containing feed to said dewaxing zone from said hydrotreating zone such that said feed contains about 0.5 to about 5 percent hydrogen sulfide by volume.

2. The method of claim 1 wherein said feed contains about 1 to 3 percent hydrogen sulfide by volume.

3. The method of claim 1 wherein said feed contains about 2 percent hydrogen sulfide by volume.

4. The method of claim 1 wherein said catalytic dewaxing is carried out at liquid hourly space velocities ranging from about 0.1 to 10 and hydrogen feed rates ranging from about 500 to 5000 s.c.f.b.

5. The method of claim 4 wherein the hydrogen feed contains about 2 percent hydrogen sulfide by volume and said catalytic dewaxing is carried out at temperatures ranging from about 260° to 371° C. (500° to 700° F.), pressures ranging from about 400° to 2000 psig, liquid hourly space velocities ranging from about 0.2 to 2 and hydrogen feed rates ranging from about 1000 to 3000 s.c.f.d.

6. The method of claim 1 wherein the hydrotreating catalyst comprises a cobalt-molybdate hydrogenation component on an alumina support.

7. The method of claim 1 wherein the hydrotreating catalyst comprises a nickel-molybdate hydrogenation component on an alumina support.

8. The method of claim 1 wherein the hydrotreating zone utilizes liquid hourly space velocities ranging from about 0.1 to 10 and hydrogen/hydrogen sulfide feed rates ranging from 500 to 5000 s.c.f.b.

9. The method of claim 1 wherein the hydrotreating zone utilizes a temperature ranging from about 260° to 371° C. (500° to 700° F.), pressures ranging from about 400 to 2000 psig, liquid hourly space velocities ranging from about 0.2 to 2 and hydrogen/hydrogen sulfide feed rates ranging from about 1000 to 3000 s.c.f.b.

10. The method of claim 1 wherein the hydrotreating zone effluent is monitored to determine its content of hydrogen sulfide.

11. The method of claim 10 wherein said effluent is maintained at about 0.5 to about 5 percent hydrogen sulfide by volume in said effluent by adding hydrogen sulfide or hydrogen thereto.

12. The method of claim 11 wherein said effluent is maintained at about 1 to about 3 percent hydrogen sulfide by volume.

13. The method of claim 11 wherein said effluent is maintained at about 2 percent hydrogen sulfide by volume.

* * * * *

UNITED STATES PATENT AND TRADEMARK OFFICE

CERTIFICATE OF CORRECTION

PATENT NO. : 4,549,955

DATED : October 29, 1985

INVENTOR(S) : Stuart S. Shih

It is certified that error appears in the above-identified patent and that said Letters Patent is hereby corrected as shown below:

Col. 3, l. 2, "antioxicant" should be --antioxidant--.

Col. 3, l. 17, "Increases of" should be --Increases in--.

Col. 4, l. 22, "related" should be --relates--.

Col. 7, l. 59, "fraction" should be --oxidation--.

Signed and Sealed this

*Eighth* Day of *April 1986*

[SEAL]

*Attest:*

DONALD J. QUIGG

*Attesting Officer*

*Commissioner of Patents and Trademarks*